US007690526B1

(12) United States Patent
Hoff

(10) Patent No.: US 7,690,526 B1
(45) Date of Patent: Apr. 6, 2010

(54) CLOSURE ASSEMBLY

(75) Inventor: James A. Hoff, Waterloo, IN (US)

(73) Assignee: Rieke Corporation, Auburn, IN (US)

( * ) Notice: Subject to any disclaimer, the term of this patent is extended or adjusted under 35 U.S.C. 154(b) by 1500 days.

(21) Appl. No.: 10/602,905

(22) Filed: Jun. 24, 2003

(51) Int. Cl.
*B65D 41/04* (2006.01)
*B65D 6/40* (2006.01)

(52) U.S. Cl. ..... 220/304; 220/254.8; 220/601

(58) Field of Classification Search ..... 220/254.8, 220/304, 601, 661; 215/331
See application file for complete search history.

(56) References Cited

U.S. PATENT DOCUMENTS

| | | | | | |
|---|---|---|---|---|---|
| 1,526,375 | A | * | 2/1925 | Riegel | 220/304 |
| 1,574,085 | A | * | 2/1926 | Hammer | 215/331 |
| 1,640,508 | A | * | 8/1927 | Lobl | 383/60 |
| 1,838,285 | A | * | 12/1931 | Rieke | 220/254.8 |
| 2,209,081 | A | * | 7/1940 | Rocic | 220/214 |
| 2,459,668 | A | | 1/1949 | Melichar | 285/55 |
| 3,255,916 | A | | 6/1966 | Rice | 220/39 |
| 3,380,618 | A | | 4/1968 | Phillips | 220/39 |
| 3,893,487 | A | | 7/1975 | Engelking | 138/89 |
| 3,905,091 | A | | 9/1975 | LaRocque | 29/460 |
| 4,105,135 | A | | 8/1978 | Bradshaw et al. | 220/288 |
| 4,117,949 | A | | 10/1978 | Dwinell | 220/304 |
| 4,124,140 | A | * | 11/1978 | Ziegler et al. | 220/304 |
| 4,164,304 | A | | 8/1979 | Roberson | 220/465 |
| 4,711,365 | A | | 12/1987 | Fomby | 220/288 |
| 4,905,862 | A | | 3/1990 | Dwinell et al. | 220/303 |
| 5,211,304 | A | * | 5/1993 | Stolzman | 220/304 |
| 5,320,237 | A | * | 6/1994 | Stolzman | 220/257.2 |
| 5,680,953 | A | | 10/1997 | Baughman | 220/288 |
| 5,862,936 | A | | 1/1999 | Johanson | 220/304 |
| 5,971,189 | A | * | 10/1999 | Baughman | 220/288 |
| 6,065,627 | A | | 5/2000 | Johanson | 220/304 |
| 6,726,048 | B2 | * | 4/2004 | Dwinell et al. | 220/257.2 |

OTHER PUBLICATIONS

Printout from www.eatel.net, "Coastal Containers Closing Directions", Coastal Containers, Inc., Baton Rouge, LA, pp. 1-6.
Printout from www.con-techinternational.com, "Products—Drum Closures", Con-Tech International, Inc., New Orleans, LA, pp. 1-7.
"ViseGrip® Flanges", Rieke Corporation, Auburn, IN, 1991.

* cited by examiner

*Primary Examiner*—Anthony Stashick
*Assistant Examiner*—James N Smalley
(74) *Attorney, Agent, or Firm*—Woodard, Emhardt, Moriarty, McNett & Henry LLP

(57) ABSTRACT

A closing plug for receipt by a threaded flange that is assembled into a drum end includes an externally-threaded body for receipt by the threaded flange. A radial flange is arranged adjacent a first end of the threaded body and the radial flange has a modified hex shape, thereby providing six flange portions. An outer section of each flange portion is formed into an axially-protruding projection such that as the closing plug is advanced into the radial flange, the axially-protruding projections abut up against a portion of the drum end in order to limit the threaded advancement of the plug. The abutment of the axially-protruding projections occurs after the desired tightening torque on the plug as received by the threaded flange has been achieved.

12 Claims, 4 Drawing Sheets

CLOSURE ASSEMBLY

BACKGROUND OF THE INVENTION

The present invention relates to the design and construction of a closure assembly that includes a receiving flange, a seal, and a closing plug that is constructed and arranged to be received by the flange. The receiving flange is secured to a container, such as in the drum end of a large industrial container. More specifically, the present invention relates to a unique design and construction for the closing plug of the closure assembly that includes in one embodiment a torque-limiting feature. In a related embodiment of the present invention, the closing plug is constructed and arranged to capture the seal.

Large, industrial, metal containers are typically configured with a filling/dispensing opening and a smaller vent opening. These openings must be securely and tightly closed and sealed whenever product is shipped. These are normally over-the-road shipments and several Department of Transportation (D.O.T.) standards or regulations apply. While there may be any number of additional industry standards depending on the container specifics and the product being shipped, it is important for the container openings to be securely closed and the realities of the container construction and the applicable D.O.T. standards dictate a fairly limited range of design options for fabricating and closing the two openings. One of these container construction realities is the limited thickness of the metal comprising the drum end where the two openings are typically and preferably located.

One fabrication technique that has proven to be successful is to pierce an opening in the metal drum end or "head" and form the surrounding metal into a raised receiving boss. An internally-threaded metal flange with a serrated peripheral edge is then assembled into the receiving boss. A metal forming operation follows and this operation shapes the drum end metal around the serrations as well as under and over the flange in order to securely and tightly anchor the flange into the receiving boss. The forming operation is performed in a manner that results in the drum end metal overlaying the upper surface of the flange immediately adjacent the threaded opening of the flange. The flange thickness in the area of the threads is greater than the material thickness of the drum end, thereby enabling a sufficient number of threads to be formed in the flange for receipt of the closing plug. The drum end alone is too thin to yield a sufficient number of threads for adequate threaded capture of the closing plug based upon the applicable D.O.T. standards that have to be met.

Since the transported, stored, and dispensed contents of containers (i.e., drums) of the type described are liquid, it is important to include an annular gasket or seal that is compressed between the drum end metal that overlays the flange and the plug surface to help seal the interface between the flange and the closing plug. One of the concerns expressed for this type of closure is the possibility that the closing plug is not properly tightened into the receiving flange. This could be either not tightened enough to adequately compress the seal or tightened too much such that the seal looses its resiliency.

Typically, the determination of proper plug tightening relies on a torque wrench and proper tightening by the filler of the drum. Visually, there is no way to tell if the closing plugs have been properly installed and thus a drum shipment could be loaded where one or more of the plugs do not meet the D.O.T. requirements. If the truck is stopped and the load inspected by a D.O.T. officer, it could fail the D.O.T. inspection. The inspection procedure includes applying a torque wrench to one or more of the closing plugs of the shipment in order to test whether those plugs are properly tightened and meet the torque level set by the D.O.T. If any one closing plug is not properly tightened, the container fails and the entire shipment can be rejected and must then be returned in order to have all of the closing plugs checked and tightened. Since each drum is not checked by the D.O.T. officer and since many or most of the drums could in fact meet the D.O.T. requirements, the penalty of finding any one closing plug that is not properly tightened is relatively harsh.

In order to address this concern, a first embodiment of the present invention was conceived and includes a new design for the closing plug such that visual confirmation can be made as to whether or not the closing plug is properly tightened into the receiving flange such that it will pass the D.O.T. inspection. An additional benefit derived from the present invention is the ability to set the torque on the closing plug within the desired range such that the cooperating annular seal is properly compressed. Importantly, all of this occurs without the need to utilize a torque wrench at the time of filling or at the time of shipment.

These invention benefits are achieved by redesigning the closing plug to include axially-protruding portions that abut up against that portion of the drum end that overlays the upper surface of the receiving flange. By properly sizing the axial length of these protruding portions based on the thread pitch of the plug and flange, any taper of the plug threads, and the size and composition of the annular gasket, the desired tightening torque occurs as the advancing surface of each protruding portion first contacts the drum end portion overlaying the receiving flange, according to the first embodiment of the present invention. Preferably, the desired tightening torque is reached and the protruding portions then abut up against the drum end portion within one further revolution of the closing plug. Ideally, abutment occurs within one-half of a revolution of the closing plug.

The plug construction, according to the first embodiment of the present invention, provides a unique torque limiting structure that also provides a visual indication of whether or not the proper torque has been set on the closing plug. If the protruding portions are in contact with the drum end portion, then it is known, based on the calculations that can be performed, that the correct tightening torque for the closing plug is "automatically" set. Once it is understood that protruding portion contact equates to the proper torque setting, any D.O.T. inspection can be done visually. Importantly, the filler and/or shipper can also perform a visual inspection at any time after the plug is threaded into the receiving flange. This enables the filler and/or shipper to ensure that whatever containers are loaded for shipment will pass any D.O.T. inspection.

Another benefit of the present invention relates to the axial compression of the annular gasket. A square-cut annular gasket may be used or an O-ring gasket can be used. With a square-cut circular gasket that has an inside diameter size slightly smaller than the outside diameter of the plug at the assembly location, the gasket can actually be preassembled to the plug. As the plug is tightened, the gasket is compressed. Since there is nothing surrounding or enclosing the gasket in the prior art arrangement, it is possible for the gasket to move radially outwardly as plug compression occurs. With a fixed volume of material, this radial movement reduces the axial thickness of the gasket, potentially requiring additional threaded advancement of the plug into the flange in order to achieve the requisite sealing.

A first embodiment of the present invention focuses on the abutment of the protruding portions against the drum end portion overlaying the flange. A second embodiment of the present invention focuses on the use of the protruding portions as a structure that encloses the gasket, thereby controlling any radial shift and/or radial expansion. With the present invention, the protruding portions are positioned radially outwardly of the gasket and, as a result, they actually enclose the gasket. Depending on the size of the gasket, its material and compressibility, and depending upon its positioning or alignment relative to the plug, if there would be the risk of substantial outward radial movement of the gasket during compression, the protruding portions are effective to capture the gasket and limit any such outward radial movement and thereby help to maintain an axial thickness for proper sealing. Accordingly, the structural improvement made to the closing plug in the form of the protruding portions constitutes a novel and unobvious advance in the art.

SUMMARY OF THE INVENTION

A closing plug for receipt by a threaded flange that is assembled into a drum end according to one embodiment of the present invention comprises a threaded body for receipt by the threaded flange, a radial flange arranged adjacent a first end of the threaded body, and a plurality of axially-protruding projections extending from an outer portion of the radial flange in the direction of the drum end for limiting the threaded advancement of the plug by abutment of the plurality of axially-protruding projections against a surface.

One object of the present invention is to provide an improved closure assembly.

Related objects and advantages of the present invention will be apparent from the following description.

DESCRIPTION OF THE PREFERRED EMBODIMENTS

Figure 1:
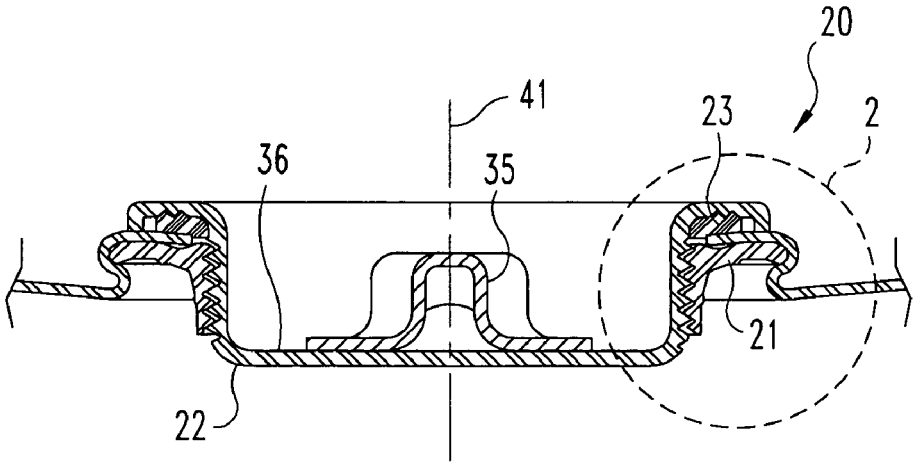
FIG. 1 is a front elevational view of a closure assembly according to a typical embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
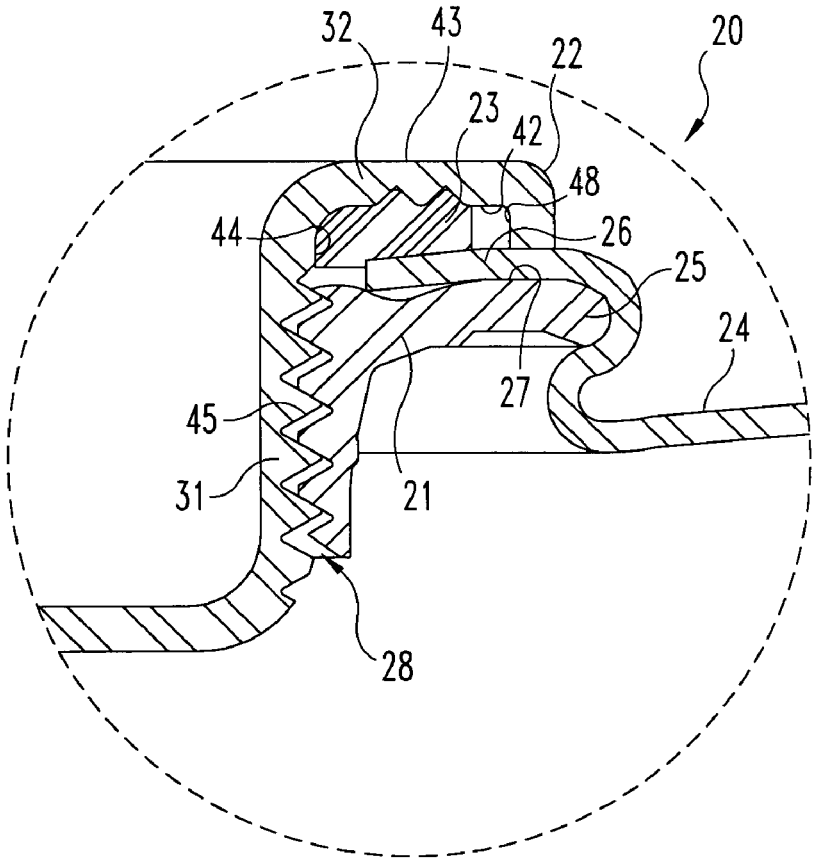
FIG. 2 is a partial, enlarged detail of one portion of the FIG. 1 closure assembly.
Figure 3:
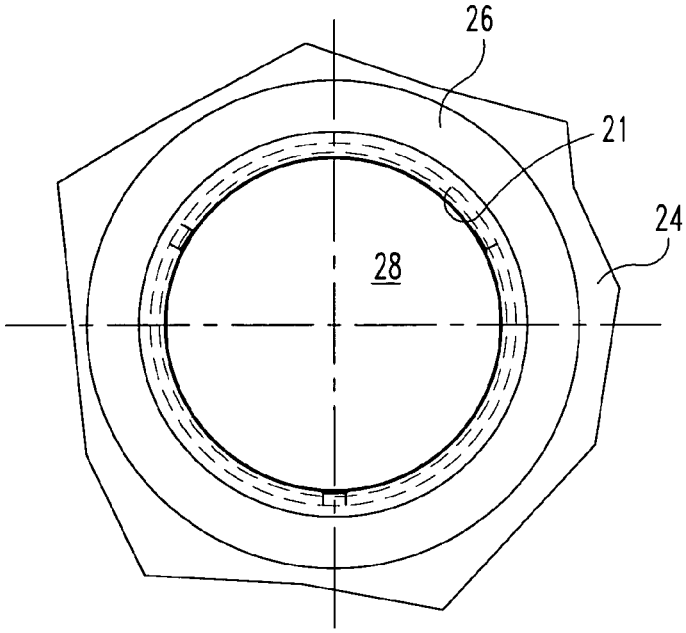
FIG. 3 is a top plan view of a receiving flange, comprising one portion of the closure assembly, as received within a drum end.

Referring to FIGS. 1 and 2, there is illustrated a drum closure 20 that includes the assembly of an internally-threaded flange 21, a closing plug 22, and an annular sealing gasket 23. The metal of the drum end 24 is formed beneath, over, and around the radial lip 25 of flange 21 in order to anchor flange 21 in position in drum end 24. A portion 26 of the drum end overlays the upper surface 27 of flange 21 and extends radially inwardly to a location adjacent the internally-threaded opening 28. FIG. 3 is a top plan view of the flange 21 as installed in the drum end 24.

Figure 4:
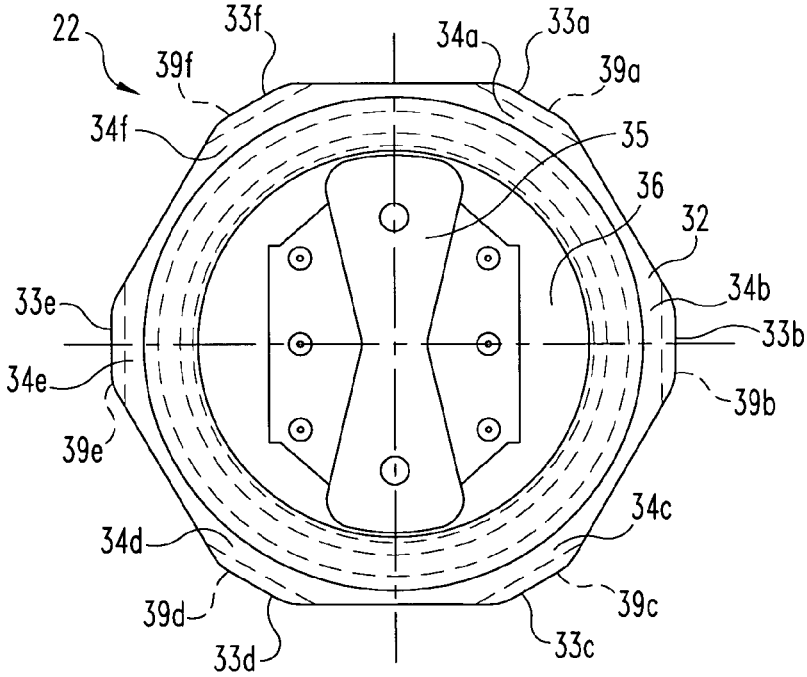
FIG. 4 is a top plan view of a closing plug comprising one component of the FIG. 1 closure assembly, according to the present invention.

The closing plug 22 includes an externally-threaded body 31 and a modified hex-shaped upper radial flange 32 (see FIG. 4). The reference herein to a "modified" hex shape includes the flattening of each of the six "points" of the peripheral hex shape, resulting in straight edges 33*a*-33*f* corresponding to flat portions 34*a*-34*f*. The interior of plug 22 includes a structure 35 for the tightening of plug 22 into flange 21. In the preferred embodiment, structure 35 has a bow-tie shape and is welded to the lower, inner surface 36 of plug 22.

Figure 5:
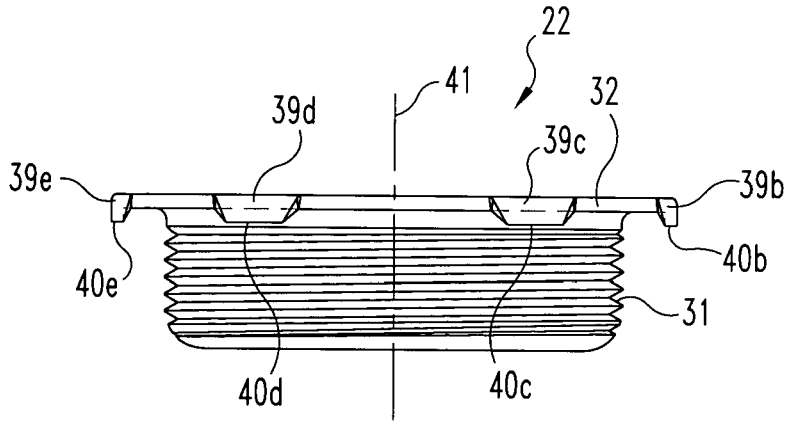
FIG. 5 is a front elevational view of the FIG. 4 closing plug.
Figure 6:
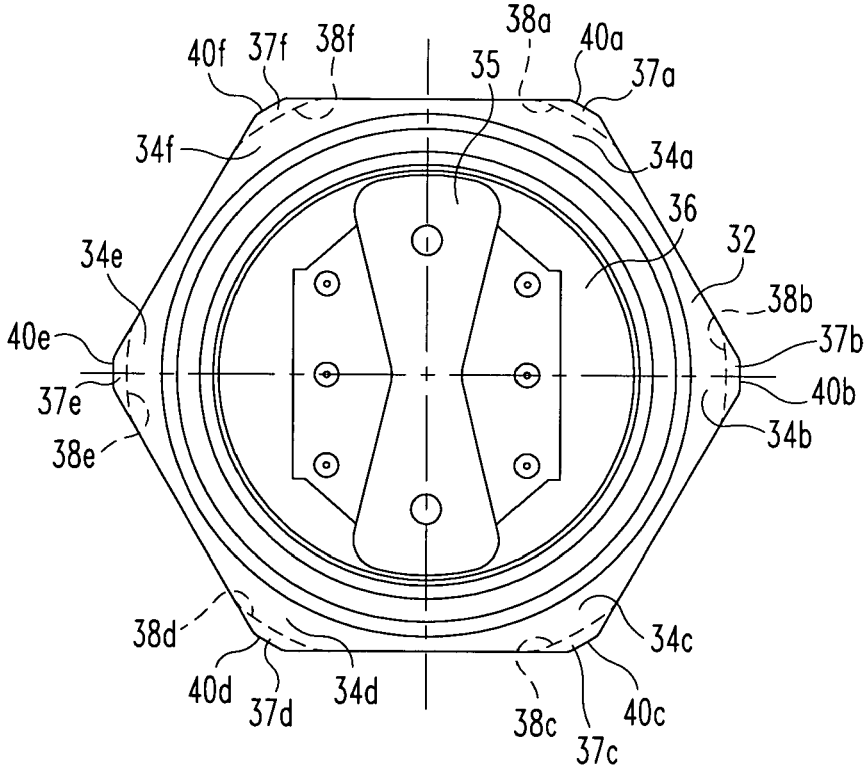
FIG. 6 is a top plan view of the FIG. 4 closing plug prior to forming protruding projections as illustrated in FIG. 5.

The starting configuration of flange 32 is illustrated in FIG. 6 wherein the "corner" portions 37*a*-37*f* have an extended shape (i.e., radially longer). The broken lines 38*a*-38*f* represent a bend line location for converting each portion 37*a*-37*f* into the combination of corresponding flat portion 34*a*-34*f* and a corresponding axially downwardly protruding portion 39*a*-39*f*. The conversion of each portion 37*a*-37*f* into its corresponding portion 34*a*-34*f* and protruding portion 39*a*-39*f* is accomplished by a bending or forming operation. Bending each portion 37*a*-37*f* at the location of its broken line 38*a*-38*f* results in the smaller portions 34*a*-34*f* in combination with axially downwardly protruding portions 39*a*-39*f*, see FIG. 5. For example, and as would be understood, portion 37*a* is bent at line 38*a* in order to create portion 34*a* that is in unitary combination with protruding portion 39*a*. This particular structure and the conversion from one configuration to the other is repeated for the remaining five portions 37*b*-37*f*. The resulting size and shape of the radial flange 32 of closing plug 22 corresponds to the size and shape of the prior art plug of this modified-hex style, except for the addition of the six, equally-spaced axially protruding portions 39*a*-39*f*.

With a modified hex design for closing plug 22, two of the structural features that are provided pertain specifically to the protruding portions 39*a*-39*f*. First, by configuring the "corners" of the original (FIG. 6) hex flange portions 37*a*-37*f* with substantially straight edges 40*a*-40*f*, the lowermost surface 40*a*-40*f* of each protruding portion 39*a*-39*f* is substantially straight and ultimately, substantially perpendicular to the longitudinal axis 41 of drum closure 20. Second, by starting with a hex design, there are six protruding portions 39*a*-39*f* that are generally equally spaced around the periphery. The number of protruding portions can be increased or decreased consistent with the present invention and the intended functioning of the resulting design. The design embodiment with six protruding portions corresponds to the modified hex shape of the closing plug while still providing a plurality of protruding portions 39*a*-39*f* for abutment against portion 26 and for capture of sealing gasket 32.

Variations to the disclosed embodiment of the present invention include protruding portions with different shapes and providing a different number of protruding portions. Since the extended outermost section of each portion 37*a*-37*f* is technically "added" to the starting configuration of the radial flange so that there will be material available to form or bend into the protruding projections 39*a*, 39*f*, this added material at each "corner" can be shaped in a variety of styles. Further, since this is "added" material, if it is omitted from one or more of the "corners", the number of protruding portions is decreased. Further, by changing the hex shape of the closing plug flange to a differently shaped polygon, such as an octagon, the number of axially protruding portions can be increased.

In the preferred embodiment of the present invention, the axial length of each protruding portion 39*a*-39*f* measures approximately 0.06 inches from the undersurface 42 of flange 32 or approximately 0.12 inches from the upper surface 43 since the upper radial flange 32 has a material thickness of approximately 0.06 inches. However, the axially protruding length of each portion 39*a*-39*f* is a function of the amount of material added to crate portions 37*a*-37*f* and the location of the bend lines 38*a*-38*f*. As will be described in the context of one embodiment of the present invention, it is important for the protruding portions 39*a*-39*f* to contact surface 27 shortly after the plug 22 is tightened into flange 21 to the required or specified torque. Accordingly, the dimensions of flange 21, the thickness of portion 26, the starting location of the threaded engagement between the plug 22 and the flange 21, and the thread pitch all have a bearing on what the axially protruding length of each projection 39*a*-39*f* needs to be.

As plug 22 is threaded into flange 21, the sealing gasket 23 that is preassembled around plug 22 is axially compressed between the undersurface of flange 32 and portion 26. With continued advancement of plug 22, the required torque for continued advancement of plug 22 increases. At some point in this process, the specified or required torque is reached, indicating that the plug is sufficiently tightened in the receiving flange to meet the manufacturer's specification and presumably suitable to meet any D.O.T. requirements. When the required or specified torque is reached, this is also the point in the assembly at which the opening 28 is both closed by plug 22 and adequately sealed by the positioning and compression of sealing gasket 23. It is to be noted that the size and the material of the sealing gasket 23, including its durometer, are relevant in achieving the desired torque. These sealing gasket 23 parameters also influence the extent of axial travel of plug 22 into the flange 21, until the desired torque is reached.

Presumably the required or desired torque corresponds with whatever is required by D.O.T. specifications for the over-the-road transport of containers (drums) of the type disclosed herein, based upon the size, materials, and construction of the container and based, to some extent, on the contents. Currently, prior to the present invention, D.O.T. inspections involve a random check of the tightening torque on the closing plugs for closures of this type. At the present time, prior to the present invention, there is no way for the filler, the shipper, or the D.O.T. inspector to visually inspect the drum closures to determine whether or not the applied tightening torque is sufficient. If a single plug is found to be below the required tightening torque, the entire load is typically rejected and might have to be returned or a fine could be assessed.

With the present invention, the axially protruding length of each protruding portion 39*a*-39*f* is set based upon all of the other applicable dimensions and relationships including component locations such that the required tightening torque on the closing plug 22 is first achieved and shortly thereafter, preferably less than one full rotation of plug 22, the lowermost surfaces 40*a*-40*f* come into contact against the upper surface of portion 26. This abutment provides a mechanical stop to the continued advancement of the plug into the receiving flange. This in turn prevents any over-tightening of the plug while, at the same time, ensuring that the required tightening torque has been provided.

This first embodiment of the present invention enables anyone to visually inspect the drum closure, at any time, and confirm that the closing plug is properly tightened to the specified torque. As indicated, the abutment of surfaces 40*a*-40*f* against portion 26 prevents any over-tightening of the plug while capturing the gasket and providing a means for visual inspection. As a consequence of the present invention, the drum filler and the shipper can each readily and easily perform a visual inspection of each drum closure and, at that point, tighten any plug where there is not abutment of surfaces 40*a*-40*f* against the upper surface of portion 26. Once the D.O.T. inspectors understand the design of the present invention, drum closures can be visually inspected.

The sealing gasket 23 is an annular, square-cut gasket fabricated from a synthetic rubber or plastic material. The inside diameter of gasket 23 is slightly undersized relative to the outside diameter region 44 of plug 22. Region 44 is annular in shape and positioned above external threads 45 and below lower surface 42 of flange 32. The under-sizing of the inside diameter of gasket 23 means that it must be stretched slightly in order to assembly around region 44. This in turn helps to keep gasket 23 retained on plug 22 during initial installation as well as during any removal of the plug or re-installation.

A primary concern addressed by the first embodiment of the present invention is the possibility of the closing plug not being sufficiently tightened within the receiving flange and not having any way to easily check each closing plug without the time and expense of applying a torque wrench. With this embodiment of the present invention, each drum closure can be visually inspected, thereby providing a significant benefit and improvement in terms of time and reliability.

Another concern with existing closure designs and procedures is the possibility that the sealing gasket is over compressed (axially) such that it is no longer resilient and unable to provide adequate sealing. A related concern is that the sealing gasket will expand radially outwardly, allowing the plug to advance farther into the receiving flange and thereby reducing the amount of gasket material for axial sealing. While this concern will be greater if a softer O-ring seal is used in lieu of a firmer square-cut sealing gasket, the concern exists with virtually any style of sealing gasket. By means of the present invention, each protruding portion 39*a*-39*f* provides an outer wall or barrier or enclosure cage to capture the gasket 23 and limit the radial expansion of whatever gasket or O-ring may be used. If the closing plug 22 would be tightened into the receiving flange with too much torque such that the sealing gasket 23 would move radially outwardly, it cannot shift or move beyond the inner surface 48 of the protruding portions 39*a*-39*f*. It is not expected that the sealing gasket will move or shift radially to where the protruding portions 39*a*-39*f* will come into service to capture the gasket, in every style of closure. However, the probability is higher if a thicker sealing gasket is used or if softer gasket material is used. This may also be a greater problem depending on the gasket inside diameter size and whether or not it is allowed to radially shift relative to the plug. Ideally, there will be abutment of the lower surfaces 40*a*-40*f* before there is any significant radial movement or expansion of the sealing gasket, but regardless of any abutment, the protruding portions 39*a*-39*f* function to enclose and contain the gasket 23.

As mentioned, another possibility is that the selected sealing gasket is oversized such that it does not remain assembled onto the plug. This would then allow the sealing gasket to shift radially relative to the plug and with any over-sizing of this nature, the possibility exists that, upon compression, the gasket could expand to the point where the protruding portions 39*a*-39*f* would be encountered and, if so, the present invention design enables these protruding portions to provide a barrier in order to limit the degree of shift and retain the sealing gasket sufficiently centered in order to provide effective sealing between the plug flange 32 and portion 26.

Figure 7:
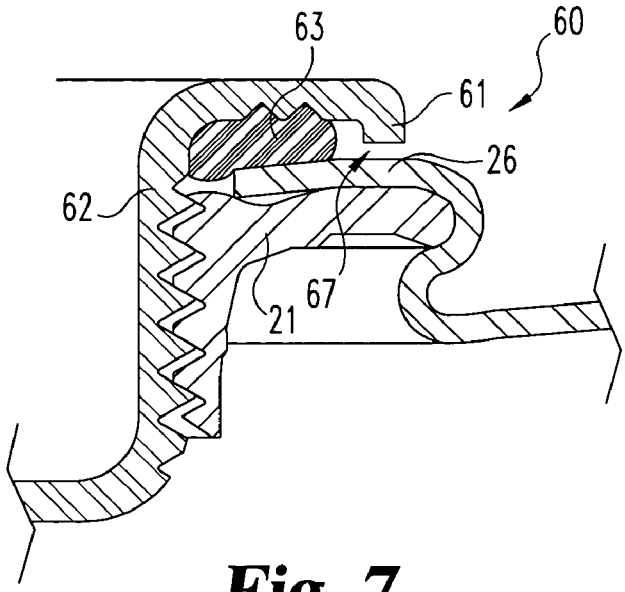
FIG. 7 is a partial, enlarged detail of an alternative embodiment of the present invention.
Figure 8:
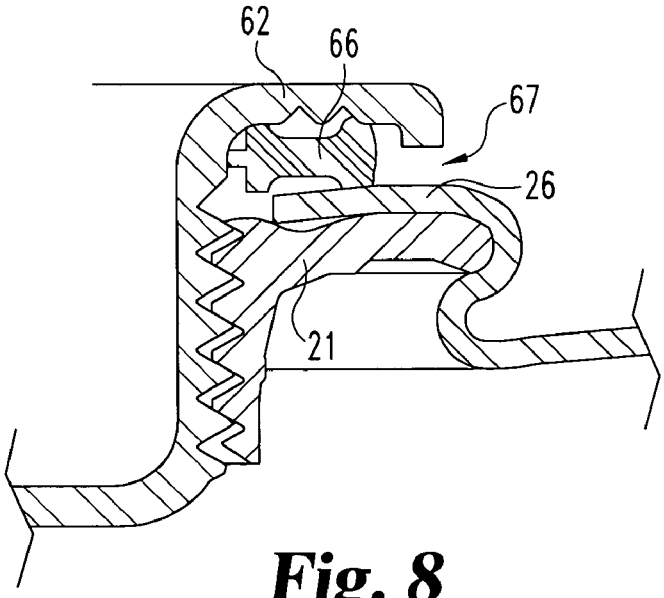
FIG. 8 is a partial, enlarged detail of an alternative embodiment of the present invention.

Referring to FIGS. 7 and 8, other embodiments of the present invention are illustrated. In both of these embodiments the protruding portions enclose and capture the sealing gasket but do not abut up against the overlaying portion of the drum end.

Referring first to FIG. 7, the illustration is intended to represent a closure 60 where the six protruding portions 61 (only one being illustrated) of the modified hex plug 62 do not abut up against portion 26 after the plug 62 is tightened into flange 21 to the specified torque. With the exception of the axial length of each protruding portion 61, and with the possible exception of the specific construction for the sealing gasket, closure 60 is substantially the same as closure 20.

If it is contemplated that a variety of gasket sizes and materials will be used with the same plug 62 and flange 21 combination, then two performance aspects of the present invention need to be considered. First, as the gasket sizes and gasket materials change, it remains important to capture the gasket and thereby limit the amount of radial shift due to any misalignment and/or the amount of radial expansion due to axial compression by the plug. The protruding portions 61 (six total in one embodiment) provide this "capture" capability for the plug, whether or not there is abutment.

Secondly, if the protruding portions 61 are too long in an axial direction, then these portions 61 could bottom out (i.e., abutment against portion 26) before the specified torque is reached. If the gasket specifics are known in advance, the plug can be uniquely configured to be compatible such that there is abutment immediately after the specified torque is reached. However, the gasket selection depends to a great extent on what chemical or product is being shipped within the corresponding container. Consequently, if a smaller, softer gasket is selected, the protruding portions could bottom out sooner than desired such that the specified torque would not be reached.

Comparing FIGS. 7 and 8, the effect of different gasket styles and materials is illustrated. In FIG. 7, the sealing gasket 63 is fabricated out of synthetic rubber. Although the axial length of the protruding portion 61 has been selected such that these portions do not abut up against portion 26, the lower edges of protruding portion 61 are still quite close to the upper surface of portion 26. In contrast, FIG. 8 illustrates the use of a plastic material for gasket 66 that is harder and less compressible than sealing gasket 63. With all other aspects of these two closure designs being equal, the harder plastic material generates a greater resistance to compression by plug 62. This means that the specific torque will be reached with less compression of the sealing gasket and, in turn, the lower edges of the protruding portion 61 are spaced farther apart from the upper surface of portion 26. Importantly, whether or not there is abutment, the protruding portions of the closing plug for the various embodiments of the present invention continue to function to enclose and capture the sealing gasket(s), regardless of the thickness, inside diameter, or material properties.

Considering the structures illustrated in FIGS. 2, 7 and 8, it will be seen that the gasket 23, 63, 66 is compressed between the underside surface of the plug flange and the upper surface of portion 26 of the drum end. It will also be seen from FIGS. 2, 5, 7, and 8 that there are clearance spaces between protruding portions 39*a*-39*f*, 61 and these clearance spaces enable the user or an inspector to visually confirm the presence of the sealing gasket as part of the combination. This visual verification with regard to the sealing gasket is possible even when the protruding portions 39*a*-39*f* are in contact with portion 26.

It is contemplated by the present invention that the closing plug of the closure will be designed such that abutment will occur, as described herein for the first embodiment, after the specified torque is reached. Preferably, there will be abutment within one revolution of the plug and, ideally, within one-half revolution. In order to achieve this result, the particular gasket, factoring in its size, shape, and material properties, needs to be determined in advance. If then a larger or harder gasket is substituted, the same plug will probably not abut up against the upper surface of portion 26. However, it is possible to design a unique plug for each of the most common gasket designs and then simply match the closing plug to the selected gasket. With regard to the idea of a "unique" plug, the only actual change that is made is in the shaping and sizing of those portions of the plug flange that will be formed or bent into the protruding projections.

Another option offered by the present invention is to simply use the protruding portions as a way to enclose and capture the gasket. This facet of the present invention has value such that a wide variety of gaskets can be used with the same plug and flange combination without any risk that the gasket can shift radially or expand radially to the point that it no longer provides adequate sealing. By providing the plurality of protruding portions, as described herein, the gasket is captured and retained in a location that enables the gasket to perform its intended function.

If a clearance space 67 between the lower edge of the protruding portions and the upper surface of portion 26 is going to result, at the specified torque, based upon the specifics of the plug and gasket, and if the axial size of this clearance space changes as the gasket changes, using the same plug, then the axial dimension of this clearance space can be determined based upon the known dimensions and material properties. This ability to determine the axial dimension of the clearance space enables the clearance space to be inspected by the use of an appropriate gauge. Whether this is a go/no go gauge that would establish an acceptable tolerance range for each type or style of gasket or a feeler gauge which would specifically determine the axial dimension of the clearance space, the point to be made is that gauging of this type may offer an easier inspection technique than using a torque wrench. Gauges of these types do not require any particular expertise to be able to use them, the cost is minimal, and they do not have to be calibrated. Presumably, once the required clearance space dimension is established for each type or style of gasket, there would be a certain degree of reliability to this particular inspection technique.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A closing plug for receipt by a threaded flange that is assembled into a drum end, said closing plug comprising:

a threaded body for receipt by said threaded flange;

a radial flange arranged adjacent a first end of said threaded body; and a plurality of spaced-apart, axially-protruding projections extending from an outer portion of said radial flange in the direction of said drum end for limiting the threaded advancement of said plug by abutment of one or more of said plurality of axially-protruding projections against a surface of said drum end.

2. The closing plug of claim 1 wherein said radial flange has a modified hex shape.

3. The closing plug of claim 2 wherein said plurality of axially-protruding projections totals six equally-spaced projections.

4. The closing plug of claim 3 wherein each axially-protruding projection is of unitary construction with said radial flange.

5. The closing plug of claim 4 having a longitudinal axis and wherein each axially-protruding projection has a substantially flat lower surface that is substantially perpendicular to said longitudinal axis.

6. The closing plug of claim 1 wherein said plurality of axially-protruding projections totals six equally-spaced projections.

7. The closing plug of claim 1 wherein each axially-protruding projection is of unitary construction with said radial flange.

8. The closing plug of claim 1 having a longitudinal axis and wherein each axially-protruding projection has a substantially flat lower surface that is substantially perpendicular to said longitudinal axis.

9. A drum closure for a drum end comprising:

a threaded flange constructed and arranged for assembly into said drum end;

a closing plug constructed and arranged for receipt by said threaded flange, said closing plug having a threaded body, a radial flange arranged adjacent a first end of said threaded body;

a plurality of spaced-apart, axially-protruding projections extending from an outer portion of said radial flange in the direction of said drum end for limiting the threaded advancement of said plug by abutment of one or more of said plurality of axially-protruding projections against a surface of said drum end; and a sealing gasket positioned around said threaded body and being constructed and arranged for sealing between said radial flange and said drum end, wherein each of said plurality of axially-protruding projections has an axial length such that contact against said drum end occurs after said closing plug is tightened into said threaded flange to a desired torque for proper sealing gasket compression wherein said radial flange has a modified hex shape.

10. The drum closure of claim 9 wherein said plurality of axially-protruding projections totals six equally-spaced projections.

11. The drum closure of claim 10 wherein each axially-protruding projection is of unitary construction with said radial flange.

12. The drum closure of claim 11 having a longitudinal axis and wherein each axially-protruding projection has a substantially flat lower surface that is substantially perpendicular to said longitudinal axis.

* * * * *